United States Patent [19]

Regan

[11] 4,340,174

[45] Jul. 20, 1982

[54] WATER HEATING APPARATUS, WATER AND HEATING SYSTEM AND IMPROVED BOILER

[76] Inventor: James Regan, 115 Lawton/4A, Yonkers, N.Y. 10705

[21] Appl. No.: 155,438

[22] Filed: Jun. 2, 1980

[51] Int. Cl.[3] ..... F24D 3/08; F24H 1/22

[52] U.S. Cl. ..... 237/19; 122/25

[58] Field of Search ..... 122/16, 17, 25; 237/8 R, 19

[56] References Cited

U.S. PATENT DOCUMENTS

| | | | |
|---|---|---|---|
| 1,029,300 | 6/1912 | Jones | 237/56 |
| 1,114,172 | 10/1914 | Miller | 237/56 |
| 1,174,586 | 3/1916 | Kehm | 237/56 |
| 1,932,069 | 10/1933 | Ercanbrack et al. | 237/56 |
| 2,509,866 | 5/1950 | Hamminger | 122/25 |
| 2,625,138 | 1/1953 | Jacoby | 122/17 |
| 3,078,044 | 2/1963 | Brandl | 237/56 |
| 3,202,355 | 8/1965 | Carlson | 237/8 R |
| 3,958,755 | 5/1976 | Cleer, Jr. | 237/8 R |

*Primary Examiner*—Ronald C. Capossela

[57] ABSTRACT

A water heater apparatus is provided comprising a substantially vertical chamber having an upper end and lower end. A lower support plate is mounted inside the chamber near the lower end. A lower gas chamber is below the support plate and a water chamber above the support plate. An upper support plate is mounted inside the chamber near the upper end. An upper gas chamber is above the support plate and the water chamber is below the support plate. A plurality of substantially vertical tubes pass through the water chamber. Each tube is mounted to the upper and lower plate at the tube ends. The interior of each tube is in fluid communication with the respective gas chambers above and below the plates. A heat source is in the lower gas chamber for producing heated gases in the lower chamber. A water inlet means to the water chamber is provided for introducing water into the water chamber and a water outlet means for removing water from the water chamber.

A heating and hot water system is also provided as well as an improved boiler which includes an auxiliary water heating apparatus. Both systems and the auxiliary water heating apparatus have as elements the water heater apparatus of this invention.

5 Claims, 6 Drawing Figures

WATER HEATING APPARATUS, WATER AND HEATING SYSTEM AND IMPROVED BOILER

FIELD OF THE INVENTION

This invention relates to improvements in a water heater apparatus, and more particularly a heating and hot water system and additionally to an auxiliary water heating apparatus for a convenient boiler.

PRIOR ART

There are many known water heater systems and heating and hot water systems, for example the following U.S. patents describe such systems: Nos.

1,029,300 to Jones;
1,114,172 to Miller;
1,174,586 to Kehm;
1,932,069 to Ercanbrack et al;
3,078,044 to Brandl;
3,202,355 to Carlson; and
3,958,755 to Cleer, Jr.

Cleer, Jr. stresses the importance of contact of combustion gases with a water containing jacket. However, Cleer, Jr. describes a complicated water tubing structure and is directed to wood burning fireplaces which are not practical in an urban environment due to pollution and availability of wood. Additionally, Cleer, Jr. does not provide sufficient contacting area between the water jacket and tubes and the combustion gases produced. Clear Jr. does not teach or suggest the heating by combustion gases of water for a hot water system, but is primarily directed to a heating system.

Jones, Ercanbrack et al and Brandl stress contacting a first water stream, e.g. water for heat, for heating another water stream, e.g. for the hot water system. These references do not teach or suggest the use of hot gases from a combustion zone in contact with a water chamber used for hot water and heating.

Miller does not have a hot water chamber heated by combustion gases.

All of the foregoing references describe devices which do not optimize the heat transfer from combustion gases to the water being heated.

SUMMARY OF THE INVENTION

It is an object of this invention to provide a highly efficient water heater apparatus which optimizes heat transfer from combustion gases to water being heated.

It is a further object of this invention to provide a heating and hot water system using the elements of the aforementioned water heater apparatus which permits the efficient use of fuel throughout the year in providing heat and hot water to, for example, a residential housing unit.

It is a further object of this invention to provide an auxiliary water heating apparatus used to increase the efficiency of a conventional boiler.

According to an aspect of this invention, a water heater apparatus is provided comprising:

(a) a substantially vertical chamber having an upper end and a lower end;

(b) a lower support plate mounted inside the chamber near the lower end, having a lower gas chamber below the support plate and having a water chamber above the support plate;

(c) an upper support plate mounted inside the chamber near the upper end having an upper gas chamber above the support plate and the water chamber below the support plate;

(d) a plurality of substantially vertical tubes passing through the water chamber, each tube mounted to the upper and lower plate at the tube ends and the interior of the tube in fluid communication with the respective gas chamber above and below the plate;

(e) a heat source in the lower gas chamber for producing heated gases in the lower chamber;

(f) a water inlet means to the water chamber for introducing water into the water chamber; and (g) a water outlet means from the water chamber for removing water from the water chamber.

Another aspect of this invention is to provide a heating and hot water system comprising:

(a) a substantially vertical chamber having an upper end and a lower end;

(b) a lower support plate mounted inside the chamber near the lower end having a lower gas chamber below the support plate and a lower water chamber above the plate;

(c) a first median support plate mounted inside the vertical chamber between the upper and lower chamber ends having a median gas chamber above the plate and the lower water chamber below the plate;

(d) a second median support plate mounted inside the vertical chamber between the upper and lower chamber ends and above the first median support plate, having the median gas chamber below the support plate and an upper water chamber above the plate;

(e) an upper support plate mounted inside the vertical chamber near the upper chamber end having an upper gas chamber above the plate and the upper water chamber below the plate;

(f) a first set of substantially vertical tubes passing through the lower water chamber, each tube mounted to the lower plate and first median support plate at the tube ends and the interior of each tube in fluid communication with the respective gas chamber above and below the plates;

(g) a second set of substantially vertical tubes passing through the upper water chamber, each tube mounted to the upper plate and the second median support plate at the tube ends and the interior of each tube in fluid communication with respective gas chamber above and below the plates;

(h) a first heat source in the lower gas chamber and a second heat source in the median gas chamber, each heat source producing heated gases in the respective chambers;

(i) a water inlet means to each water chamber for introducing water into the respective water chamber; and (j) a water outlet means from each water chamber for removing water from the respective water chamber.

It is still another aspect of this invention to provide in a boiler having a heat source for heating water in a water reservoir the improvement comprising the aforedescribed auxiliary water heating apparatus, wherein the water inlet means is in fluid communication with the lower end of the reservoir and the water outlet means is in fluid communication with the upper end of the reservoir.

DETAILED DESCRIPTION OF THE INVENTION

Figure 1:
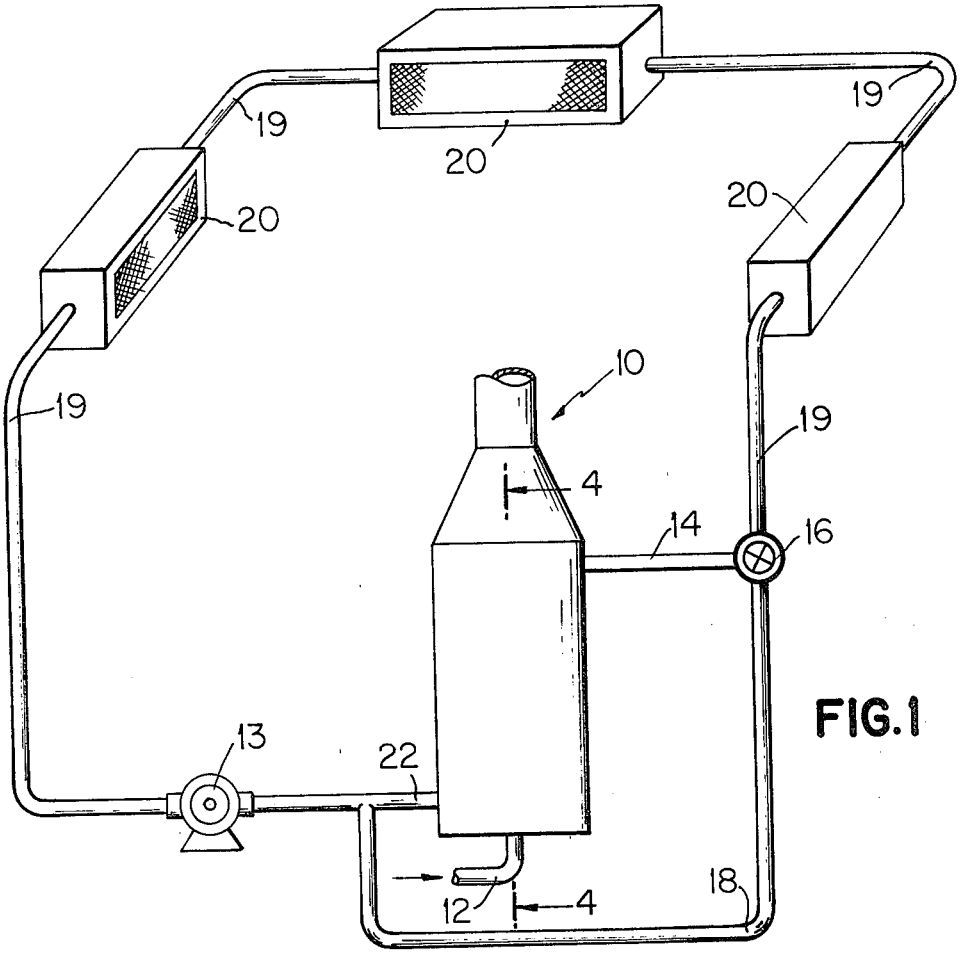
FIG. 1 is a schematic of an embodiment of a heating system using an embodiment of the water heater apparatus of this invention as the primary heating source.

Referring to FIG. 1, the water heater apparatus of this invention, generally designated (10) heats water to, for example, about 200° F. by the use of a gas burner which is fed gas through line (12). The heated water is removed through a water outlet means (14) from the water heater apparatus (10). The heated water passes to a temperature controlled mixing valve (16) wherein cooler water may be added through line (18) to adjust the water temperature leaving the valve (16) to the desired temperature. The water leaving the mixing valve (16) is directed to a series of space heaters (20) for heating a room, house, etc. The water while being cooled through the space heaters (20) is then returned to the water inlet means (22) of the water heater apparatus (10) by pump (13).

Figure 2:
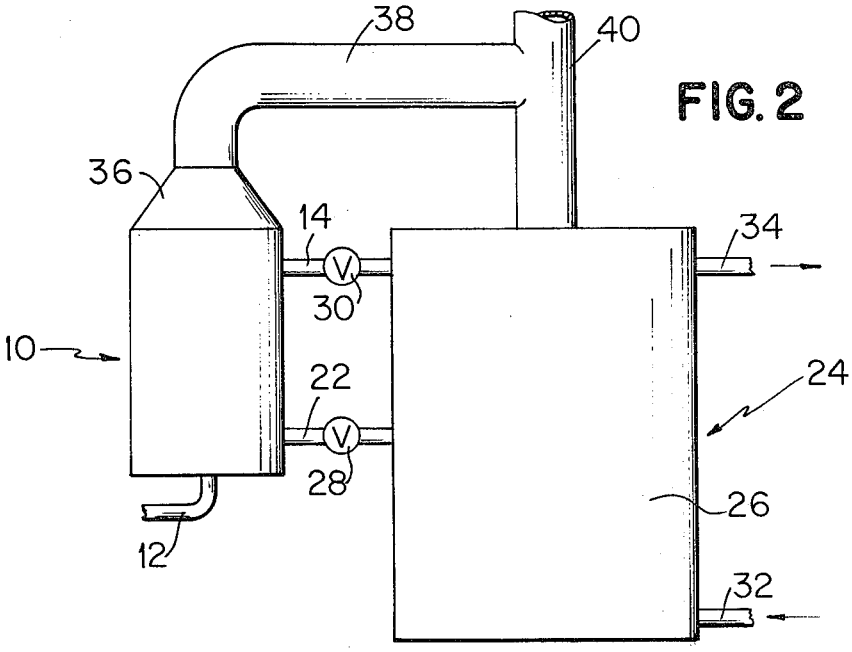
FIG. 2 is a schematic of another embodiment of a heating and hot water system using an embodiment of the water heater apparatus of this invention as an auxiliary heating apparatus for a gas or oil boiler.
Figure 3:
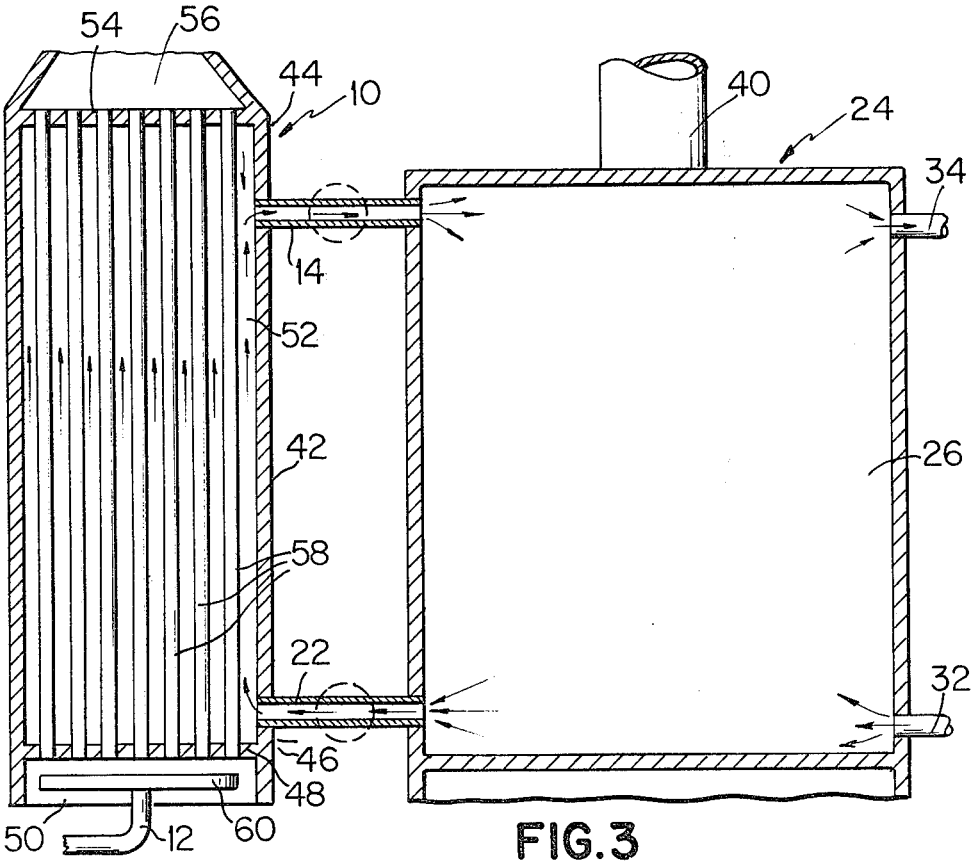
FIG. 3 is a cross sectional elevational view of the system of FIG. 2 in the absence of valves between the boiler and the water heater apparatus of this invention.

Referring to FIGS. 2 and 3, the water heater apparatus (10) of this invention is used as an auxiliary water heating means for conventional boiler (24). The conventional boiler (24) has a heat source (not shown) for heating water in a water reservoir (26). In the improved boiler systems of FIGS. 2 and 3, the water inlet means (22) is in fluid communication with the lower end of the reservoir (26). The water outlet (14) is in fluid communication with the upper end of the water reservoir (26).

In FIG. 2 the water from the water reservoir (26) flows through, for example, a check valve (28) into the auxiliary water heating apparatus (10), is heated in the apparatus (10) and flows back into the reservoir (26) after it is heated to a predetermined temperature. The predetermined temperature may be controlled, by, for example, a thermostatic control valve (30). The water from the conventional boiler (24) has a water inlet means (32), for example coming from space heaters (not shown), and a water outlet means (34) going to, for example, space heaters (not shown).

Still referring to FIG. 2, the gases from the combustion of gas from gas line (12) passes through the upper gas chamber (36), through an exhaust duct (38) to the exhaust stack (40) of the conventional boiler (24). Thus one may easily and conveniently boost the output and efficiency of a conventional boiler (24) without the expensive procedure of removing the boiler and replacing it with a larger one.

In FIG. 3, reservoir (26) of the conventional boiler (24) is connected to the water heater apparatus (10) through the inlet means (22) without any valve therebetween and water outlet means (14) is connected to reservoir (26) without a valve therebetween. Thus when the water heater apparatus (10) is in operation the water as it heats up rises and circulates from the reservoir (26) through inlet means (22), apparatus (10) and outlet means (14) and into the top of the reservoir (26). Circulation of the water is thus promoted by the heating of the water in apparatus (10); convection providing the means of circulating the water. When however, the water heater apparatus (10) is not in operation there is essentially no circulation of water through water heater apparatus (10) even without valves between the reservoir (26) and the water heater apparatus (10). Thus one can have a simple, thermostatic control (not shown) to turn off and on water heater apparatus (10) without worrying about automatic means for closing and opening of valves.

Figure 4:
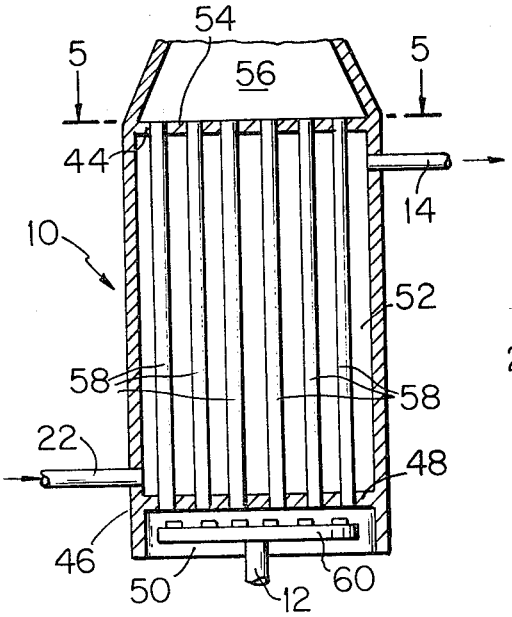
FIG. 4 is a cross section view taken along line 4—4 of FIG. 1 showing an embodiment of the water heater apparatus of this invention.
Figure 5:
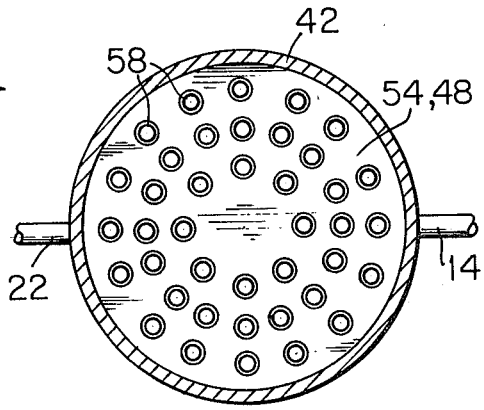
FIG. 5 is a cross sectional view taken along line 5—5 of FIG. 4.

Referring to FIGS. 3, 4 and 5 showing the water heater apparatus (10) in more detail, the apparatus (10) is comprised of a substantially vertical chamber (42) having an upper end (44) and a lower end (46). Preferably this chamber is cylindrical in shape and for optimum efficiency is insulated so that there is no substantial heat loss to the surroundings.

A lower support plate (48) is mounted to the sides of the chamber (42) near the lower end (46). A lower gas chamber (50) is thus below the support plate (48) and a water chamber (52) is above the support plate (48).

An upper support plate (54) is mounted inside the chamber (42) near the upper end (44). A lower gas chamber (56) is above the support plate (54) and the water chamber (52) is below the support plate (54).

A plurality of substantially vertical tubes (58) pass through the water chamber (52). Each tube is mounted to the upper support plate (54) and the lower support plate (48) at the tube ends. The interior of the tube (58) is in fluid communication with the respective gas chambers (50 & 56) above and below the plates (48 & 54).

A heat source (60) is provided in the lower gas chamber for producing heated gases in the lower chamber (50). Preferably the heat source (60) is provided by the burning of gas, however an electric heat source may also be utilized. Gas is preferred due to its clean burning characteristics which would inhibit fouling of the tubes (58).

A water inlet means (22) is provided for introducing water into the water chamber (52). A water outlet means (14) is also provided to removing water from the water chamber (52).

Preferably the water inlet means (22) is near the bottom of water chamber (52) and the water outlet means is near the top of water chamber (52).

In use, the heat source (60) heats the gases in chamber (50) which rise through the vertical tubes (58) transfer their heat to the water in water chamber (52) and exit through the upper gas chamber (56). The apparatus provides for the intimate contact of the gases with the walls of the vertical tubes (58) thus providing for the efficient transfer of heat from the gas to the water. When an electric heat source is utilized the gases may be recirculated to chamber (50) (not shown).

Figure 6:
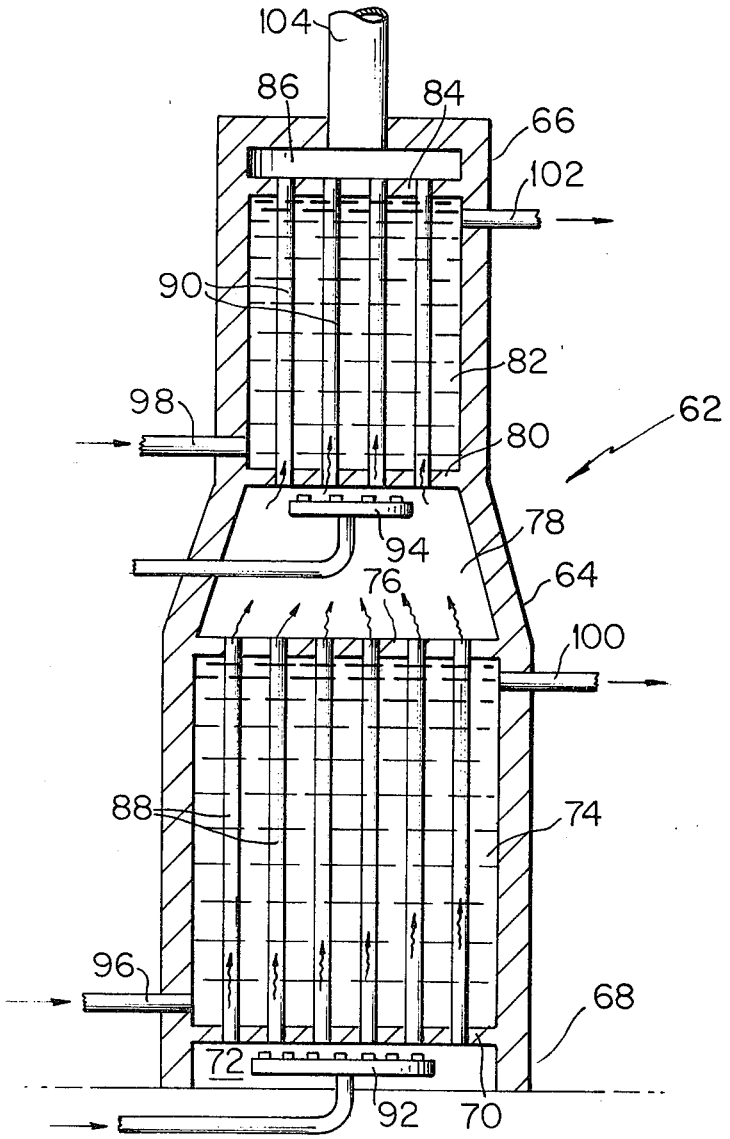
FIG. 6 is a cross sectional elevational view of a heating and hot water system in one unit using embodiments of the water heater apparatus of this invention.

In FIG. 6, a heating and hot water system is provided, generally designated (62), in one compact unit. A substantially vertical chamber (64) is provided having an upper end (66) and a lower end (68). Preferably the chamber (64) is cylindrical in shape and, as indicated, is of smaller diameter in the top section than in the bottom section.

A lower support plate (70) is mounted inside the chamber (64) near the lower end (68). A lower gas chamber (72) is below the support plate (70) and lower water chamber (74) is above the support plate (70).

A first median support plate (76) is mounted inside the vertical chamber (64) between the upper and lower ends (66 & 68). A median gas chamber (78) is provided above the plate (76) and the lower water chamber (74) is below the plate (76). A second median support plate (80) is mounted inside the vertical chamber (64) between the upper and lower ends (66 & 68) and above the first median support plate (76). The median gas chamber (78) is below the support plate (80) and an upper water chamber (82) is above the plate (80).

An upper support plate (84) is mounted inside the vertical chamber (64) near the upper end (66). An upper gas chamber (86) is above the plate (84) and the upper water chamber (82) below the plate (84).

A first set of substantially vertical tubes (88) pass through the lower water chamber (74). Each tube is mounted to the lower plate (70) and the first median support plate (76) at the tube ends. The interior of each tube is in fluid communication with the respective gas chambers (72 & 78) above and below the plate (70 & 76).

A second set of substantially vertical tubes (90) pass through the upper water chamber (82). Each tube is mounted to the upper plate (84) and the second median support plate (80) at the tube ends. The interior of each tube is in fluid communication with the respective gas chambers (78 & 86) above and below the plates (80 & 84).

A first heat source (92) is provided in the lower gas chamber (72) and second heat source (94) is provided in the median gas chamber (78). Each heat source (92 & 94) produces heated gases in the respective chambers (72 & 78).

A water inlet means (96 & 98) is provided to each water chamber (74 & 82) for introducing water into the water chamber (74 & 82). Preferably the lower water inlet means (96) is the return line from space heaters (not shown) whereas the upper water inlet means (98) is the cold water feed line for the hot water system.

A water outlet means (100 & 102) is provided for each water chamber (74 & 82) for removing water from the respective water chamber. Preferably, the lower water outlet means (100) is directed to space heaters (not shown) and the upper water outlet means (102) is directed to the hot water system of, for example, a residential housing unit.

This arrangement of the hot water and heating system provides substantial efficiency throughout the heating season. For example, in the winter time when the demand for hot water and heat is required the first heat source (92) is activated providing heated gases which pass through the first set of tubes (88) and the second set of tubes (90). Such an arrangement is particularly advantageous for the gases, passing through the first set of tubes (88) are substantially hotter than those going through the second set of tubes (90) and thus are capable of providing the extremely hot water required for space heaters, whereas the gases reaching the second set of tubes (90) are lower in temperature but still providing sufficient heat for the hot water system. The gases exit through the exhaust stack (104). Due to the low temperature of the exiting gases this may be merely a vent. In the summertime, when there is substantially no requirement for space heaters, the first heat source (92) is not activated and the second heat source (94) is activated. This heat source (94) is substantially smaller in capacity than the first heat source (92) and is generally sufficient to supply heat for the hot water system.

Thus a complete heating system and hot water system may be installed in, for example, a residential housing unit, in one compact unit having high efficiency.

While the invention has been described in terms of a preferred embodiment thereof, its scope is intended to be limited only by the claims here appended.

What is claimed is:

1. A heating and hot water system comprising:

(a) a substantially vertical chamber having an upper end and a lower end;

(b) a lower support plate mounted inside the chamber near the lower end having a lower gas chamber below the support plate and a lower water chamber above the plate;

(c) a first median support plate mounted inside the vertical chamber between the upper and lower chamber ends having a median gas chamber above the plate and the lower water chamber below the plate;

(d) a second median support plate mounted inside the vertical chamber between the upper and lower chamber ends and above the first median support plate, having the median gas chamber below the support plate and an upper water chamber above the plate;

(e) an upper support plate mounted inside the vertical chamber near the upper chamber end having an upper gas chamber above the plate and the upper water chamber below the plate;

(f) a first set of substantially vertical tubes passing through the lower water chamber, each tube mounted to the lower plate and first median support plate at the tube ends and the interior of each tube in fluid communication with the respective gas chamber above and below the plates;

(g) a second set of substantially vertical tubes passing through the upper water chamber, each tube mounted to the upper plate and the second median support plate at tube ends, and the interior of each tube in fluid communication with the respective gas chamber above and below the plates;

(h) a first heat source in the lower gas chamber and a second heat source in the median gas chamber, each heat source producing heated gases in the respective chambers;

(i) a water inlet means to each water chamber for introducing water into the respective water chamber;

(j) a water outlet means from each water chamber for removing water from the respective water chamber;

(k) a hot water line in fluid communication with the outlet means of the upper water chamber and space heaters in fluid communication with the outlet means of the lower water chamber; and (l) activation means for independently activating the first and second heat sources, whereby when the demand for hot water and heat is required the first heat source is activated and the second heat source is not activated providing heated gases which pass through the first set of tubes and the second set of tubes, and when there is no demand for heat but demand for hot water the first heat source is not activated and the second heat source is activated providing heated gases which only pass through the second set of tubes.

2. The system of claim 1, wherein the heat sources are gas burners.

3. The system of claim 1, wherein the vertical chamber is a cylindrical chamber.

4. The system of claim 1, wherein the water inlet means are near the bottoms of the respective water chambers and the water outlet means are near the tops of the respective water chambers.

5. A boiler having a heat source for heating water in a water reservoir and an exhaust stack the improvement comprising an auxiliary water heating apparatus comprising:

(a) a substantially vertical chamber having an upper end and a lower end;

(b) a lower support plate mounted inside the chamber near the lower end, having a lower gas chamber below the support plate and having a water chamber above the support plate;

(c) an upper support plate mounted inside the chambers near the upper end having an upper gas chamber above the support plate and the water chamber below the support plate;

(d) a plurality of substantially vertical tubes passing through the water chamber, each tube mounted to the upper and lower plate at the tube ends and the interior of the tube in fluid communication with the respective gas chambers above and below the plate;

(e) a heat source in the lower gas chamber for producing heated gases in the lower chamber;

(f) a water inlet means to the water chamber for introducing water into the water chamber; and (g) a water outlet means from the water chamber for removing water from the water chamber, wherein the water inlet is in fluid communication with the lower end of the reservoir and the water outlet is in fluid communication with the upper end of the reservoir and the upper gas chamber of the water heating apparatus is in fluid communication with the exhaust stack of the boiler.

* * * * *